US010510505B2

(12) United States Patent
Kimura et al.

(10) Patent No.: US 10,510,505 B2
(45) Date of Patent: Dec. 17, 2019

(54) FUSE UNIT AND METHOD OF MANUFACTURING FUSE UNIT

(71) Applicant: Pacific Engineering Corporation, Ogaki-shi (JP)

(72) Inventors: Masahiro Kimura, Ogaki (JP); Toshihisa Iwakura, Ogaki (JP)

(73) Assignee: PACIFIC ENGINEERING CORPORATION, Ogaki-Shi (JP)

( * ) Notice: Subject to any disclaimer, the term of this patent is extended or adjusted under 35 U.S.C. 154(b) by 64 days.

(21) Appl. No.: 15/570,622

(22) PCT Filed: Sep. 9, 2016

(86) PCT No.: PCT/JP2016/076546
§ 371 (c)(1),
(2) Date: Oct. 30, 2017

(87) PCT Pub. No.: WO2017/175405
PCT Pub. Date: Oct. 12, 2017

(65) Prior Publication Data

US 2018/0301307 A1 Oct. 18, 2018

(30) Foreign Application Priority Data

Apr. 6, 2016 (JP) ..... 2016-076374

(51) Int. Cl.
*H01H 69/02* (2006.01)
*H01H 85/20* (2006.01)
*H01H 85/175* (2006.01)

(52) U.S. Cl.
CPC ..... *H01H 69/02* (2013.01); *H01H 85/203* (2013.01); *H01H 85/205* (2013.01);
(Continued)

(58) Field of Classification Search
CPC ..... H01H 69/02; H01H 85/205; H01H 2085/2055; H01H 2085/2075;
(Continued)

(56) References Cited

U.S. PATENT DOCUMENTS 7,663,465 B2 * 2/2010 Matsumoto ..... H01H 85/044 337/187
2009/0163085 A1 * 6/2009 Makino ..... H01H 85/2035 439/701

(Continued)

FOREIGN PATENT DOCUMENTS

JP 2005339965 A 12/2005
JP 2013084453 A 5/2013

(Continued)

OTHER PUBLICATIONS

International Search Report for PCT/JP2016/076546 dated Nov. 15, 2016 with English translation (4 pages).

*Primary Examiner* — Jacob R Crum
(74) *Attorney, Agent, or Firm* — Shumaker, Loop & Kendrick, LLP

(57) ABSTRACT

The present invention provides a fuse unit, which reduces the number of components of a bus bar and eliminates alignment of tuning fork terminals, and a method of manufacturing the fuse unit. Disclosed is a method of manufacturing a fuse unit, which includes a bus bar including a battery terminal, a fuse connection terminal, and an external connection terminal and is manufactured by integrating the bus bar and a resin covering body by insert molding. In this manufacturing method, the fuse connection terminal is constituted of an input side tuning fork terminal connected to the battery terminal and an output side tuning fork terminal connected to the external connection terminal, the input side tuning fork terminal and the output side tuning fork terminal are connected by a joining portion so as to face each other,
(Continued)

the bus bar including the fuse connection terminal is integrated with the resin covering body by insert molding. After the insert molding, the joining portion is cut and removed through a cutting window of the resin covering body, which exposes the joining portion to the outside, and the input side tuning fork terminal and the output side tuning fork terminal are separated.

4 Claims, 10 Drawing Sheets

(52) U.S. Cl.
CPC ..... *H01H 85/175* (2013.01); *H01H 2085/208* (2013.01); *H01H 2085/209* (2013.01); *H01H 2229/048* (2013.01)

(58) Field of Classification Search
CPC ..... H01H 2085/208; H01H 2085/209; H01H 2229/048; H01H 85/175; H01H 85/203
See application file for complete search history.

(56) References Cited

U.S. PATENT DOCUMENTS

| | | | | |
|---|---|---|---|---|
| 2010/0060407 | A1* | 3/2010 | Iwata | H01H 69/02 337/227 |
| 2013/0181806 | A1* | 7/2013 | Onoda | H01H 69/02 337/222 |
| 2013/0316584 | A1* | 11/2013 | Taguchi | H01H 69/02 439/620.26 |
| 2015/0340189 | A1* | 11/2015 | Onoda | H01H 85/10 337/191 |
| 2016/0064887 | A1* | 3/2016 | Ishikawa | H01H 85/044 264/138 |

FOREIGN PATENT DOCUMENTS

| | | | |
|---|---|---|---|
| JP | 2014022303 | A | 2/2014 |
| JP | 2014222970 | A | 11/2014 |

* cited by examiner

FUSE UNIT AND METHOD OF MANUFACTURING FUSE UNIT

TECHNICAL FIELD AND BACKGROUND

The present invention relates to a fuse unit to be used mainly for, for example, an electric circuit for an automobile, and relates particularly to a fuse unit in which a bus bar and a resin covering body are integrated by insert molding, and a method of manufacturing the fuse unit.

In the prior art, fuse units have been used to protect an electric circuit mounted in an automobile or the like and various electric components connected to the electric circuit. Specifically, when an unintended overcurrent flows in the electric circuit, a fusing portion fuses due to heat generated by overcurrent to protect the various electric components so as not to allow excess current to flow through the electric components.

There are various kinds of fuse units depending on the application, and, for example, the fuse unit described in Patent Literature 1 is used for connecting an on-board battery and electric wires supplying power to various electric components. In such an on-board fuse unit, there is a possibility that a bus bar is damaged by vibration of a vehicle body. Thus, a resin is poured and insert-molded in a state where the bus bar is disposed in a molding die, whereby the bus bar and a resin covering body are integrated to avoid damage of the bus bar due to vibration.

The fuse unit may be provided with a tuning fork terminal used for attaching an arbitrary fuse from the outside. Specifically, as shown in a bus bar 700 in FIGS. 6(*a*) and 6(*b*), the bus bar 700 is constituted of a battery terminal plate 710, a connection side terminal plate 720, and a fuse connection terminal 730 constituted of a pair of tuning fork terminals, and a fuse is inserted into and attached to the fuse connection terminal 730 from the outside.

Here, a method of manufacturing a fuse unit 800 including the bus bar 700 will be described. First, the battery terminal plate 710 and the connection side terminal plate 720 which are in a state of being connected and integrated with each other, as shown in FIGS. 6(*a*) and 6(*b*), are arranged on a fixed side mold plate (not shown). Then, an output side tuning fork terminal 732 is disposed on the fixed side mold plate so as to face an input side tuning fork terminal 731 extending from the battery terminal plate 710. In this state, a movable side mold plate is mated with the fixed side mold plate from the upper side of the fixed side mold plate, and a cavity is formed. Then, when a resin is injected into the cavity, the fuse unit 800, as shown in FIG. 7, in which the bus bar 700 and a resin covering body 810 are integrated is completed.

As shown in FIG. 7, a distal end side of the fuse connection terminal 730 is exposed to outside of the resin covering body 810, and a plate-like blade-type fuse can be inserted into and attached to the distal end of the fuse connection terminal 730. Specifically, an insertion groove is formed in a central portion of each of the input side tuning fork terminal 731 and the output side tuning fork terminal 732, so that metal terminals on both sides of the blade-type fuse are inserted into the respective insertion grooves.

However, in order to insert and attach the blade-type fuse into and to the fuse connection terminal 730, the input side tuning fork terminal 731 and the output side tuning fork terminal 732 are required to be precisely aligned so as to face each other, and if the input side tuning fork terminal 731 and the output side tuning fork terminal 732 are slightly misaligned, it becomes difficult to insert the blade-type fuse.

Accordingly, the operation of placing the output side tuning fork terminal 732 on the fixed side mold plate and aligning the position requires a high degree of accuracy, and a manufacturing work of the fuse unit is very troublesome. In addition, at the time of insert molding, it is necessary to prepare the output side tuning fork terminal 732 which is a separate part and to dispose the output side tuning fork terminal 732 on the mold plate, so that the number of components of the bus bar necessary for insert molding is increased corresponding to the output side tuning fork terminal 732.

CITATIONS LIST

Patent Literatures

Patent Literature 1: JP-A 2005-339965

SUMMARY

Thus, the present invention provides a fuse unit, which reduces the number of components of a bus bar and eliminates alignment of tuning fork terminals, and a method of manufacturing the fuse unit.

A method of manufacturing a fuse unit according to the present invention is a method of manufacturing a fuse unit, which includes a bus bar including a battery terminal, a fuse connection terminal, and an external connection terminal and is manufactured by integrating the bus bar and a resin covering body by insert molding. In this manufacturing method, the fuse connection terminal is constituted of an input side tuning fork terminal connected to the battery terminal and an output side tuning fork terminal connected to the external connection terminal, the input side tuning fork terminal and the output side tuning fork terminal are connected by a joining portion so as to face each other, and the bus bar including the fuse connection terminal is integrated with the resin covering body by insert molding. After the insert molding, the joining portion is cut and removed through a cutting window of the resin covering body, which exposes the joining portion to the outside, and the input side tuning fork terminal and the output side tuning fork terminal are separated.

According to the above feature, since the bus bar in which the input side tuning fork terminal and the output side tuning fork terminal are connected so as to face each other is used, unlike the prior art, it is unnecessary to dispose a separate output side tuning fork terminal on a fixed side mold plate at the time of alignment, the number of components of the bus bar to be prepared at the time of insert molding is reduced, and furthermore, a mold used for manufacturing a single output side tuning fork terminal is unnecessary, so that manufacturing cost can be reduced.

Further, since the bus bar in which the input side tuning fork terminal and the output side tuning fork terminal are connected so as to face each other is manufactured by being integrated with the resin covering body by insert molding, unlike the prior art, it is unnecessary to precisely align the input side tuning fork terminal and the output side tuning fork terminal on the fixed side mold plate so as to face each other, and the manufacturing work of the fuse unit is facilitated. Furthermore, the joining portion can be easily cut and removed through the externally facing cutting window after insert molding.

In the method of manufacturing a fuse unit according to the present invention, the bus bar includes a plurality of the fuse connection terminals, and while the fuse connection terminals are in parallel to each other, base end portions of the input side tuning fork terminals are connected to integrate the fuse connection terminals.

According to the above feature, while the fuse connection terminals are in parallel to each other, the connecting portions of the base end portions are connected to integrate the fuse connection terminals, so that a positional relationship of the fuse connection terminals is not shifted during insert molding or other working process. Thus, a plurality of fuses can be reliably inserted into the fuse connection terminal.

A fuse unit according to the present invention includes a bus bar including a battery terminal, a fuse connection terminal, and an external connection terminal and in which the bus bar and a resin covering body are integrated. In this fuse unit, the fuse connection terminal is constituted of an input side tuning fork terminal connected to the battery terminal and an output side tuning fork terminal connected to the external connection terminal, the input side tuning fork terminal and the output side tuning fork terminal are connected by a joining portion so as to face each other, and the resin covering body includes a cutting window which exposes the joining portion to the outside. The joining portion is cut and removed to separate the input side tuning fork terminal and the output side tuning fork terminal.

According to the above feature, since the bus bar in which the input side tuning fork terminal and the output side tuning fork terminal are connected so as to face each other is used, unlike the prior art, it is unnecessary to dispose a separate output side tuning fork terminal on a fixed side mold plate at the time of alignment, the number of components of the bus bar to be prepared at the time of insert molding is reduced, and furthermore, a mold used for manufacturing a single output side tuning fork terminal is unnecessary, so that manufacturing cost can be reduced. Unlike the prior art, it is unnecessary to precisely align the input side tuning fork terminal and the output side tuning fork terminal on the fixed side mold plate so as to face each other, and the manufacturing work of the fuse unit is facilitated. Furthermore, the joining portion can be easily cut and removed through the externally facing cutting window after insert molding.

In the fuse unit according to the present invention, the bus bar includes a plurality of the fuse connection terminals, and while the fuse connection terminals are in parallel to each other, base end portions of the input side tuning fork terminals are connected to integrate the fuse connection terminals.

According to the above feature, while the fuse connection terminals are in parallel to each other, the connecting portions of the base end portions are connected to integrate the fuse connection terminals, so that a positional relationship of the fuse connection terminals is not shifted during insert molding or other working process. Thus, a plurality of fuses can be reliably inserted into the fuse connection terminal.

Advantageous Effects of Invention

As described above, according to the fuse unit and the method of manufacturing the fuse unit according to the present invention, the number of components of the bus bar is reduced, and, at the same time, alignment of tuning fork terminals is eliminated.

DETAILED DESCRIPTION

Hereinafter, an embodiment of the present invention will be described with reference to the drawings. The embodiment to be described below exemplify shapes and materials of respective members included in a fuse unit and will not be limited to the exemplified shapes and materials. In this specification, a "front/front side" is a side where a fuse connection terminal 130 protrudes in a front view of a bus bar 100 shown in FIG. 1(*a*). A "back/back side" is opposite to the "front/front side".

Figure 1B:
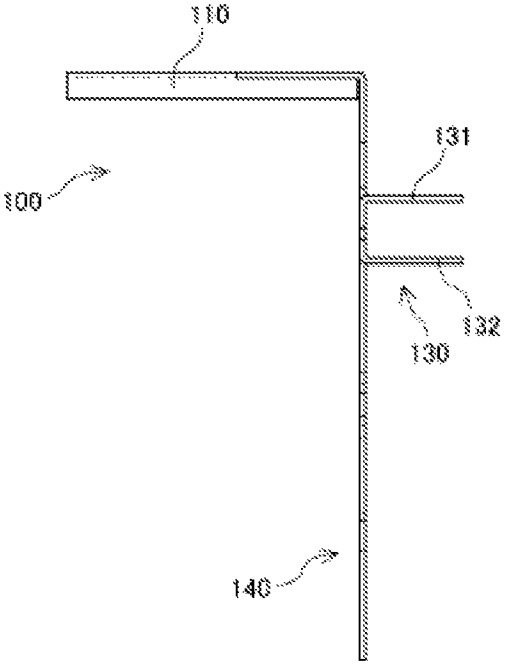
FIG. 1(*a*) is a front view of a bus bar of a fuse unit of the present invention, FIG. 1(*b*) is a side view of the bus bar, and FIG. 1(*c*) is a plan view of the bus bar.
Figure 1A:
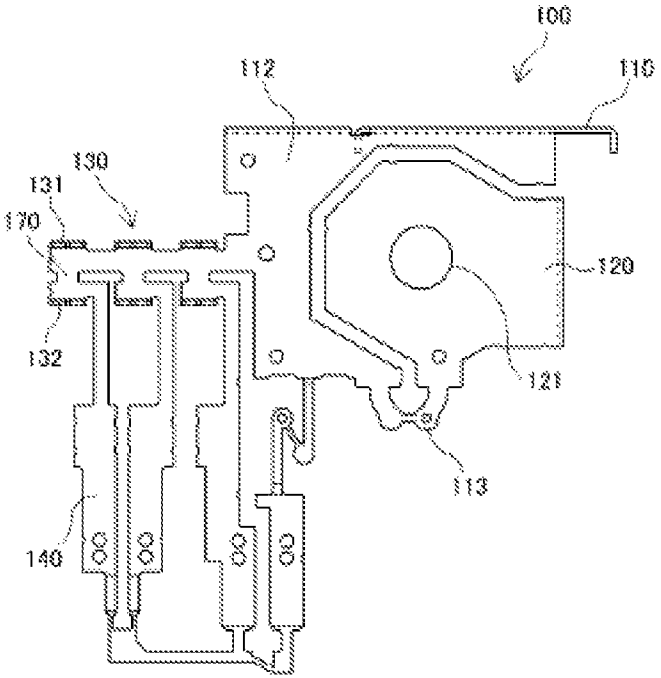
Figure 1C:
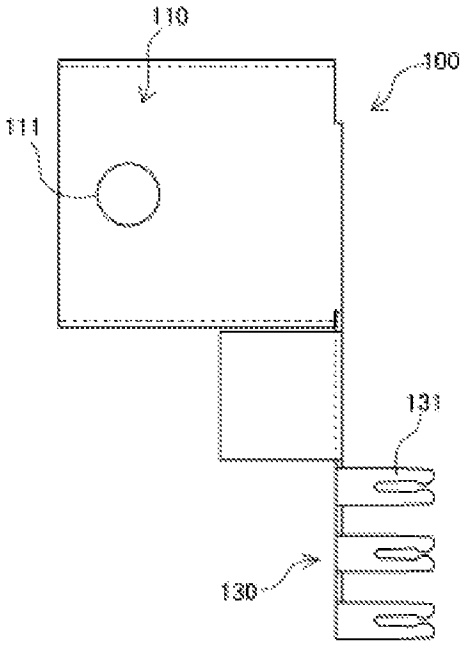

FIGS. 1(*a*) to 1(*c*) show the bus bar 100 of the fuse unit according to the present invention. The bus bar 100 is formed from a single thin plate-like metal plate and constituted of a battery terminal 110, a connection side terminal plate 120, a plurality of fuse connection terminals 130, and an external connection terminal 140. The battery terminal 110 is connected to a circuit portion 112, and the connection side terminal plate 120 is connected to the circuit portion 112 via a fusing portion 113. Thus, if an overcurrent flows from a power source side connected to a stud bolt hole 111 of the battery terminal 110, the fusing portion 113 fuses, so that it is possible to protect loads of various electric components and the like connected to a connecting bolt hole 121 of the connection side terminal plate 120.

One end of the fuse connection terminal 130 is connected to the circuit portion 112, and the other end is connected to the external connection terminal 140. Thus, if an overcurrent flows from the power source side connected to the stud bolt hole 111 of the battery terminal 110, a fuse attached to the fuse connection terminal 130, which will be described later, fuses, so that a load connected to the external connection terminal 140 can be protected.

Next, a method of forming the bus bar 100 will be briefly described. First, a flat plate-like member formed of a conductive metal such as copper or its alloy and having a uniform thickness is punched out into a predetermined shape with a press machine or the like. Then, the battery terminal 110 is folded by approximately 90 degrees, and the input side tuning fork terminal 131 and the output side tuning fork terminal 132 of the fuse connection terminal 130 are also folded by approximately 90 degrees, whereby the bus bar 100 shown in FIGS. 1(*a*) to 1(*c*) is completed.

Figure 2A:
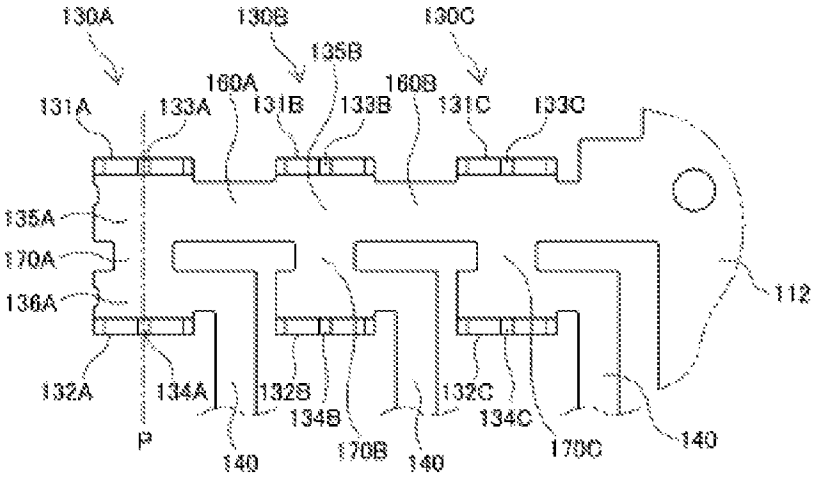
FIG. 2(*a*) is an enlarged front view of a fuse connection terminal of the bus bar shown in FIGS. 1(*a*) to 1(*c*), and FIG. 2(*b*) is an enlarged side view of the fuse connection terminal.
Figure 2B:
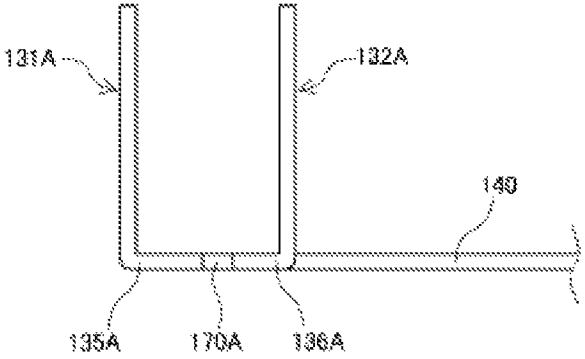

Next, a detailed configuration of the fuse connection terminal 130 will be described with reference to FIGS. 2(*a*) and 2(*b*). As shown in FIG. 2(*a*), a fuse connection terminal 130A is constituted of a pair of an input side tuning fork terminal 131A and an output side tuning fork terminal 132A, and the input side tuning fork terminal 131A and the output side tuning fork terminal 132A are provided with insertion grooves 133A and 134A, respectively. The input side tuning fork terminal 131A and the output side tuning fork terminal 132A are connected by a joining portion 170A so as to face each other, and, more precisely, so as to be located on the same straight line of a straight line P. The insertion grooves 133A and 134A are also located on the same straight line of the straight line P. As shown in FIG. 2(*b*), the input side tuning fork terminal 131A and the output side tuning fork terminal 132A are connected by the joining portion 170A so as to rise in mutually parallel state.

A base end portion 135A of the input side tuning fork terminal 131A is connected to a base end portion 135B of an adjacent fuse connection terminal 130B by a joining portion 160A, and a base end portion 136A of the output side tuning fork terminal 132A is connected to the external connection terminal 140. Since the fuse connection terminal 130B is connected to an adjacent fuse connection terminal 130C by a joining portion 160B, a current from the circuit portion 112 can flow to the input side tuning fork terminal 131A. As will be described later, the current from the circuit portion 112 passes through the input side tuning fork terminal 131A and then through the fuse inserted into the fuse connection terminal 130A and flows from the output side tuning fork terminal 132A to the external connection terminal 140. The fuse connection terminals 130B and 130C are configured exactly the same as the fuse connection terminal 130A.

Figure 3B:
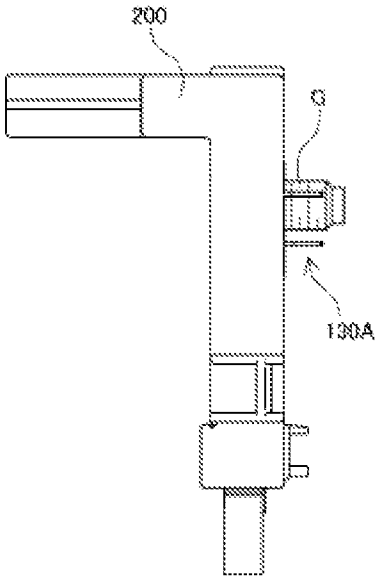
FIG. 3(*a*) is a front view of the fuse unit of the present invention, FIG. 3(*b*) is a side view of the fuse unit, and FIG. 3(*c*) is a plan view of the fuse unit.
Figure 3A:
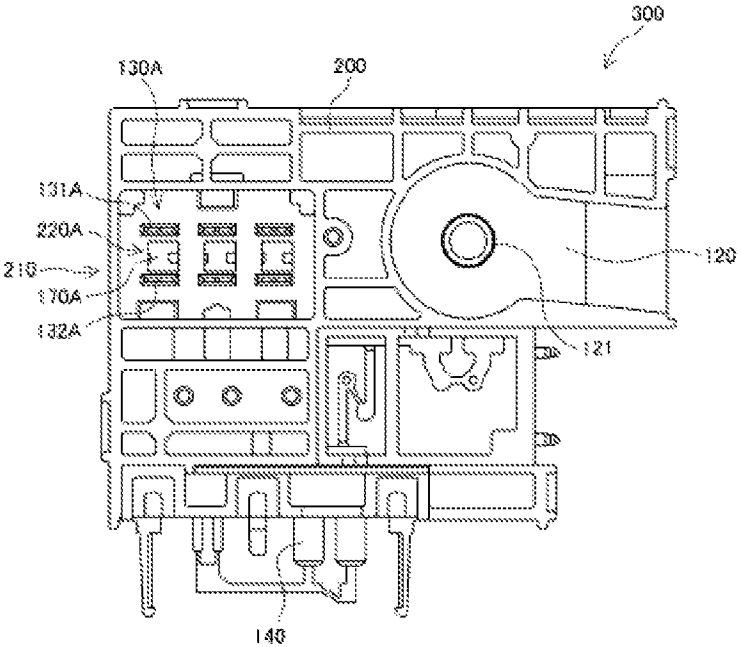
Figure 3C:
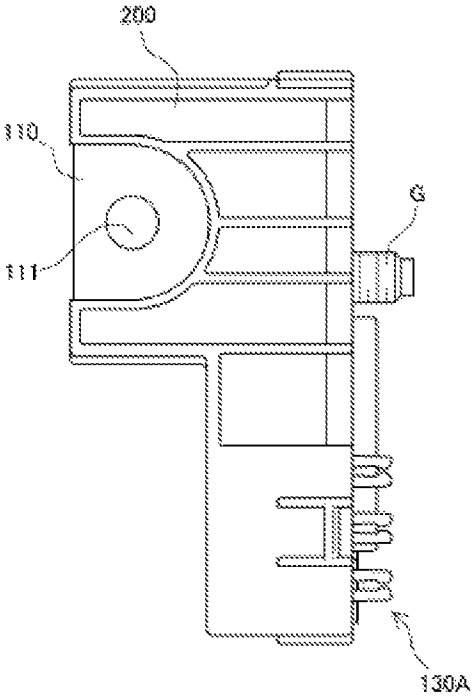

Next, a method of manufacturing a fuse unit 300 will be described with reference to FIGS. 3(*a*) to 3(*c*). First, the bus bar 100 in a state shown in FIGS. 1(*a*) to 1(*c*) is placed on a fixed side mold plate (not shown) as it is such that a back surface side of the bus bar 100 faces the fixed side mold plate. Then, a movable side mold plate (not shown) is mated with the fixed side mold plate from the front side of the bus bar 100, a cavity is formed, and a resin is injected into the cavity. Then, as shown in FIGS. 3(*a*) to 3(*c*), the bus bar 100 and the resin covering body 200 are integrated while the front side and the back side of the bus bar 100 are covered with the resin covering body 200. In this manner, the fuse unit 300 in which the bus bar 100 and the resin covering body 200 are integrated by insert molding is manufactured.

As shown in FIGS. 3(*a*) to 3(*c*), a dent portion 210 used for attaching a fuse is formed on a surface of the fuse unit 300, and the input side tuning fork terminal 131A and the output side tuning fork terminal 132A of the fuse connection terminal 130A protrude from the dent portion 210. A distal end of the external connection terminal 140 protrudes from a lower end of the resin covering body 200. The stud bolt hole 111 of the battery terminal 110 is exposed at an upper end side of the resin covering body 200 in order to connect to the power source side. The connection side terminal plate 120 is exposed from a portion of a surface of the resin covering body 200, so that a load can be connected. A connection bolt G is attached to a connection bolt hole 121 of the connection side terminal plate 120.

In the resin covering body 200, cutting windows 220A having the same shape are respectively provided on both the front side and the back side of the joining portion 170A, and the joining portion 170 A is exposed to the outside through the cutting window 220A. A material constituting the resin covering body 200 is an insulating resin which is melted at the time of injection and then can be cooled and hardened.

Next, a method of cutting and removing the joining portion 170 will be described in detail with reference to FIGS. 4 and 5. First, when the joining portion 170A exposed through the cutting window 220A is cut and removed with a tool or the like, the state shown in FIGS. 4(*a*) to 4(*c*) is obtained. Similarly, since cutting windows 220B are provided on both a front surface and a back surface of a joining portion 170B, the joining portion 170B is cut and removed with a tool or the like from the front side or the back side of the joining portion 170B. Since cutting windows 220C adjacent to the cutting windows 220B are similarly provided on both a front surface and a back surface of a joining portion 170C, the joining portion 170C is cut and removed with a tool or the like from the front side or the back side of the joining portion 170C.

Figure 5:
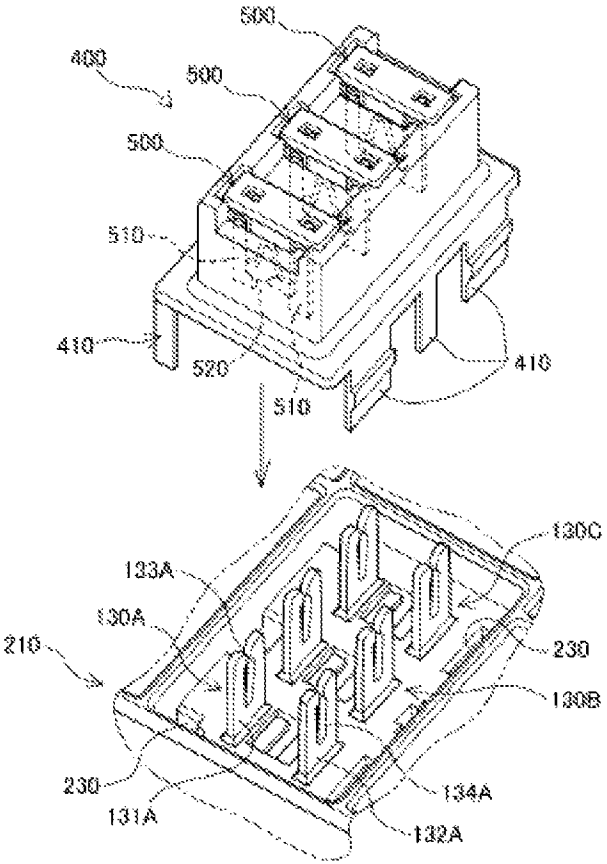
FIG. 5 is an enlarged perspective view of the dent portion of the resin covering body of the fuse unit of the present invention and a fuse.
Figure 6B:
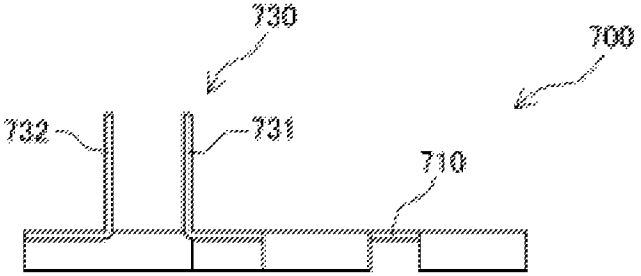
FIG. 6B (prior art)
FIG. 6(*a*) is a front view of a bus bar of a fuse unit of the prior art according to the present invention, and FIG. 6(*b*) is a side view of the bus bar.
Figure 6A:
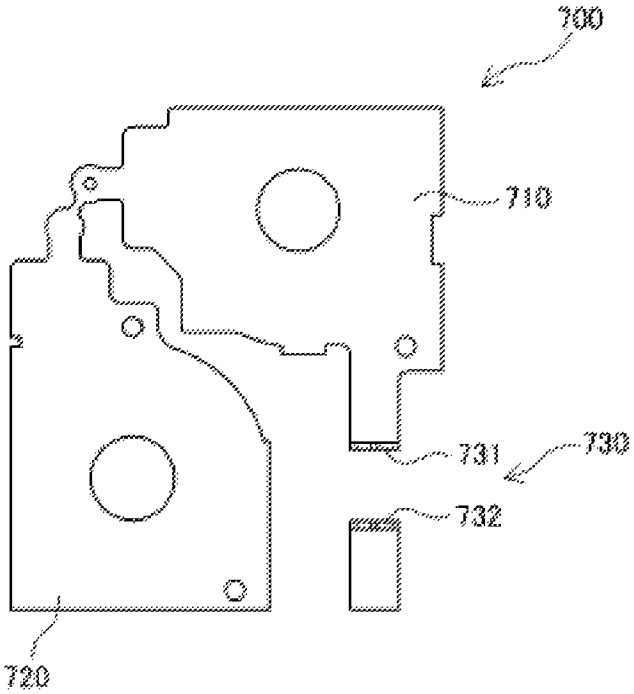
FIG. 6A (prior art)
Figure 7:
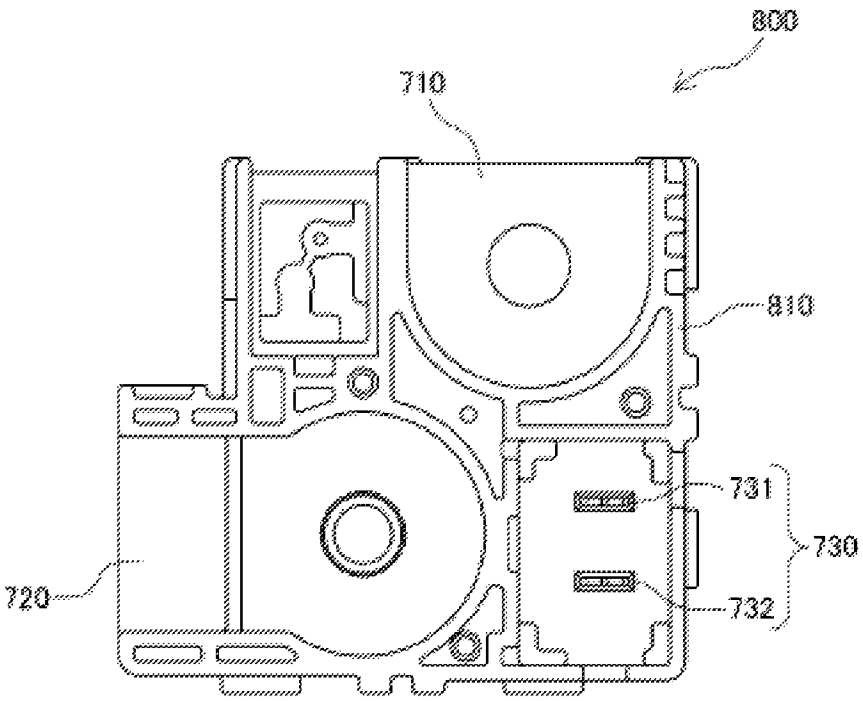
FIG. 7 (prior art)
FIG. 7 is a front view of the fuse unit of the prior art according to the present invention.

Consequently, all the joining portions 170 are cut and removed, so that the input side tuning fork terminal 131 and the output side tuning fork terminal 132 of each of the fuse connection terminals 130 are separated as shown in FIG. 5. Consequently, the manufacture of the fuse unit 300 is completed. The joining portion 170 is cut and removed after insert molding because if the input side tuning fork terminal 131 and the output side tuning fork terminal 132 remain connected by the joining portion 170, a current flows through the joining portion 170 and does not flow through a blade-type fuse 500 to be described later, and a load cannot be protected from an overcurrent.

As shown in FIG. 5, the completed fuse unit 300 can be used by inserting a fuse box 400 into the dent portion 210. The fuse box 400 is provided with a plurality of the plate-like blade-type fuses 500, and each of the blade-type fuses 500 can be inserted into the corresponding fuse connection terminal 130. For example, the blade-type fuse 500 is constituted of plate-like metal terminals 510 on both sides and a fusing portion 520 connected between the plate-like metal terminals 510, and the plate-like metal terminals 510 on both sides can be inserted into the insertion grooves 133A and 134A of the fuse connection terminal 130A, respectively. Consequently, a current from the power source side connected to the battery terminal 110 flows from the input side tuning fork terminal 131A of the fuse connection terminal 130A to the output side tuning fork terminal 132A via the blade-type fuse 500, and furthermore, the current flows through the external connection terminal 140 connected to the output side tuning fork terminal 132A. If an overcurrent flows from the power source side connected to the battery terminal 110, the fusing portion 520 of the blade-type fuse 500 fuses, so that it is possible to protect a load connected to the external connection terminal 140.

The respective blade-type fuses 500 can be similarly inserted into the fuse connection terminals 130B and 130C, and a load connected to the external connection terminal 140 corresponding to each of the fuse connection terminals 130 can be protected from an overcurrent. Further, since mounting portions 410 of the fuse box 400 are engaged with corresponding respective mounting holes 230 of the dent portion 210, the fuse box 400 is firmly mounted to the fuse unit 300.

As described above, according to the method of manufacturing the fuse unit 300 according to the present invention, the bus bar 100 in which the input side tuning fork terminal 131 and the output side tuning fork terminal 132 are connected so as to face each other is manufactured by being integrated with the resin covering body 200 by insert molding. Thus, unlike the prior art, it is unnecessary to precisely align the input side tuning fork terminal 131 and the output side tuning fork terminal 132 on the fixed side mold plate so as to face each other, and the manufacturing work of the fuse unit 300 is facilitated. Since the bus bar 100 in which the input side tuning fork terminal 131 and the output side tuning fork terminal 132 are connected so as to face each other is used, during insert molding or other working process, the input side tuning fork terminal 131 and the output side tuning fork terminal 132 are not deformed or not deviated from each other, so that occurrence of defective products can be prevented.

Further, unlike the prior art, it is unnecessary to dispose the separate output side tuning fork terminal 132 on a fixed side mold plate at the time of alignment, the number of components of the bus bar 100 to be prepared at the time of insert molding is reduced, and furthermore, a mold used for manufacturing the single output side tuning fork terminal 132 is unnecessary, so that manufacturing cost can be reduced.

It is necessary to cut and remove the joining portion 170 in order to separate the input side tuning fork terminal 131 and the output side tuning fork terminal 132 after insert molding; however, according to the method of manufacturing the fuse unit 300 according to the present invention, the joining portion 170 can be easily cut and removed through the externally facing cutting window 220 after the insert molding.

Figure 4B:
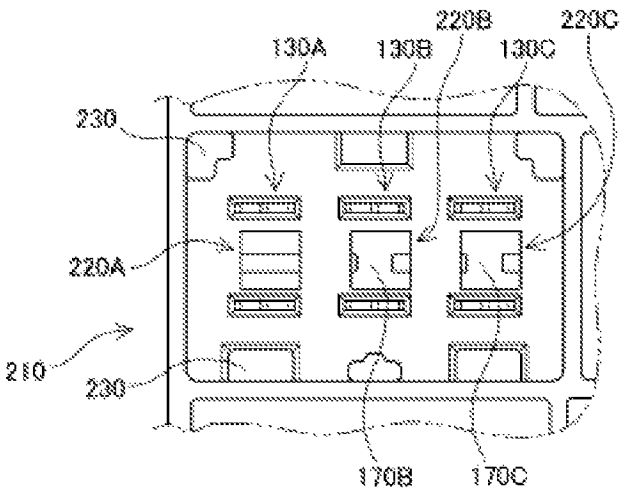
FIG. 4(*a*) is an enlarged perspective view of a dent portion of a resin covering body of the fuse unit of the present invention, FIG. 4(*b*) is an enlarged plan view of a front side of the dent portion, and FIG. 4(*c*) is an enlarged rear view of a back side of the dent portion.
Figure 4A:
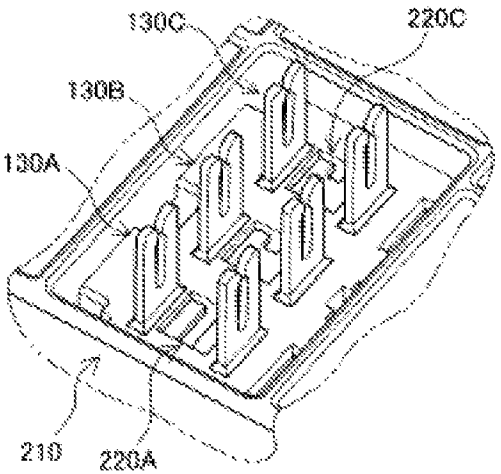
Figure 4C:
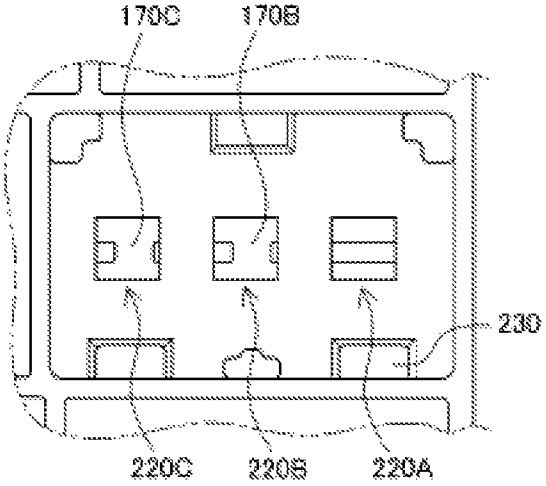

As shown in FIGS. 4(*a*) to 4(*c*), although the cutting windows 220 are formed on both surfaces of the joining portion 170, the present invention is not limited thereto. For example, the cutting window 220 may be formed only on the front or back surface side of the joining portion 170. However, when the cutting windows 220 are formed on both surfaces of the joining portion 170, it is possible to perform the cutting operation from either the cutting window 220 on the front surface or the cutting window 220 on the back surface. Since the cutting windows 220 formed on both surfaces of the joining portion 170 face the outside from the front and back surfaces of the fuse unit 300, respectively, whether or not the joining portion 170 is cut and removed can be easily confirmed visually from the front or back side.

As shown in FIGS. 4(*a*) to 4(*c*), since the cutting windows 220 are arranged on the front and back sides, respectively, so as to overlap with each other with the joining portion 170 interposed therebetween, a portion from which the joining portion 170 is cut and removed becomes a space penetrating from the front side to the back side, so that whether or not the cutting operation is completed can be confirmed reliably. A tool or the like is easily penetrated from the front side to the back side, and the joining portion 170 can be easily removed by being punched out. Even in a state where the fuse box 400 is mounted to the dent portion 210 of the fuse unit 300, it is possible to view from the outside the cutting window 220 on the side opposite to the side where the fuse box 400 is mounted, that is, on the back surface side of the fuse unit 300 in FIGS. 4(*a*) to 4(*c*). Thus, even after mounting the fuse box 400, whether or not the joining portion 170 is cut and removed can be easily confirmed visually from the cutting window 220 on the back surface side.

When it is desired to mount the fuse box 400, provided with a plurality of the blade-type fuses 500, to the fuse unit 300, it is necessary to provide a plurality of the fuse connection terminals 130, and at the time of insert molding, if the fuse connection terminals 130 are arranged in parallel such that the mutual positions of the fuse connection terminals 130 are not displaced, each of the blade-type fuses 500 can be inserted. According to the bus bar 100 of the present invention, while the fuse connection terminals 130 are connected in parallel to each other, the connecting portions 160 of the base end portions 135 are connected and integrated with each other, so that a positional relationship of the fuse connection terminals 130 is not shifted during insert molding or other working process. Thus, a plurality of the blade-type fuses 500 provided in the fuse box 400 can be inserted reliably.

Each of the connecting portions 160 connecting the fuse connection terminals 130 plays a role as a bus bar for flowing a current from the circuit portion 112 to the fuse connection terminals 130. Thus, it is unnecessary to remove the connecting portion 160 after insert molding, and the connecting portion 160 can be used as it is.

The fuse unit and the method of manufacturing the fuse unit according to the present invention are not limited to the above-mentioned embodiment, and various modifications and combinations can be performed within a range of claims and within a range of the embodiment. These modifications and combinations are also included in the range of rights.

REFERENCE SIGNS LIST

100 Bus bar
110 Battery terminal
130 Fuse connection terminal
131 Input side tuning fork terminal
132 Output side tuning fork terminal
140 External connection terminal
170 Joining portion
200 Resin covering body
220 Cutting window
300 Fuse unit

The invention claimed is:

1. A method of manufacturing a fuse unit, which comprises a bus bar comprising a battery terminal, a fuse connection terminal, and an external connection terminal and is manufactured by integrating the bus bar and a resin covering body by insert molding, the fuse unit manufacturing method comprising:

composing the fuse connection terminal from an input side tuning fork terminal connected to the battery terminal and an output side tuning fork terminal connected to the external connection terminal, and connecting the input side tuning fork terminal and the output side tuning fork terminal via a joining portion such that they face each other, integrating the bus bar comprising the fuse connection terminal with the resin covering body by insert molding, and after the insert molding, cutting and removing the joining portion through a cutting window of the resin covering body, which is provided between a base end portion of the input side tuning fork terminal and a base end portion of the output side tuning fork terminal and such that the cutting window only exposes the joining portion to the outside, separating the input side tuning fork terminal and the output side tuning fork terminal.

2. The method of manufacturing a fuse unit according to claim 1, wherein the bus bar comprises a plurality of the fuse connection terminals, and the fuse connection terminals are disposed mutually parallel, and base end portions of the input side tuning fork terminals are mutually connected to integrate the fuse connection terminals.

3. A fuse unit which comprises a bus bar comprising a battery terminal, a fuse connection terminal, and an external connection terminal, wherein the bus bar and a resin covering body are integrated, the fuse connection terminal comprising an input side tuning fork terminal connected to the battery terminal and an output side tuning fork terminal connected to the external connection terminal, the input side tuning fork terminal and the output side tuning fork terminal once connected via a joining portion such that they face each other, the resin covering body comprising a cutting window which is provided between a base end portion of the input side tuning fork terminal and a base end portion of the output side tuning fork terminal and such that the cutting window only exposes the joining portion to the outside, and the joining portion having been cut and removed so as to separate the input side tuning fork terminal and the output side tuning fork terminal.

4. The fuse unit according to claim 3, wherein the bus bar comprises a plurality of the fuse connection terminals, the fuse connection terminals are disposed mutually parallel, and base end portions of the input side tuning fork terminals are mutually connected to integrate the fuse connection terminals.

* * * * *